US012290156B2

(12) United States Patent
Kim

(10) Patent No.: US 12,290,156 B2
(45) Date of Patent: May 6, 2025

(54) EYELASH PERM TREATMENT METHOD AND EYELASH PERM TREATMENT SET APPLIED THERETO

(71) Applicant: Joo Hyun Kim, Busan (KR)

(72) Inventor: Joo Hyun Kim, Busan (KR)

( * ) Notice: Subject to any disclaimer, the term of this patent is extended or adjusted under 35 U.S.C. 154(b) by 110 days.

(21) Appl. No.: 17/774,783

(22) PCT Filed: Aug. 24, 2021

(86) PCT No.: PCT/KR2021/011273

§ 371 (c)(1),
(2) Date: May 5, 2022

(87) PCT Pub. No.: WO2022/045726

PCT Pub. Date: Mar. 3, 2022

(65) Prior Publication Data

US 2023/0172333 A1 Jun. 8, 2023

(30) Foreign Application Priority Data

Aug. 31, 2020 (KR) ..... 10-2020-0109969

(51) Int. Cl.
*A45D 2/48* (2006.01)

(52) U.S. Cl.
CPC ..... *A45D 2/48* (2013.01)

(58) Field of Classification Search
CPC ..... A45D 2/48; A45D 7/02–065; A41G 5/02
See application file for complete search history.

(56) References Cited

FOREIGN PATENT DOCUMENTS

| | | | |
|---|---|---|---|
| KR | 2005-058422 | A | 3/2005 |
| KR | 20-0414548 | | 4/2006 |
| KR | 20-0442286 | | 10/2008 |
| KR | 2014-004128 | A | 1/2014 |
| KR | 10-1426304 | | 8/2014 |
| KR | 10-2018-0136136 | | 12/2018 |
| KR | 10-2138308 | | 8/2020 |

(Continued)

OTHER PUBLICATIONS

Jeon, KR-200414548-Y1 English translation of description, 2006 (Year: 2006).*

(Continued)

*Primary Examiner* — Cris L. Rodriguez
*Assistant Examiner* — Sydney J Pulvidente
(74) *Attorney, Agent, or Firm* — ANTONIO HA & U.S. PATENT, LLC

(57) ABSTRACT

The present invention relates to an eyelash perm treatment method and an eyelash perm treatment set applied thereto. The eyelash perm treatment method of the present invention comprises: an eyelash hair root strengthening step using a magnetic rod, wherein the hair roots of the hair forming the eyelashes are strengthened using a predetermined magnetic rod having a metal plate and a magnetic plate that contacts the metal plate by means of magnetic force; and an eyelash curl sustained preservation step using a prefabricated synthetic resin rod, wherein a prefabricated synthetic resin rod, including first and second synthetic resin unit rods that can be disassembled and assembled with each other, is used to preserve, for a sustained period of time, eyelash curls that fit the appearance of the eyes.

4 Claims, 8 Drawing Sheets

(56) References Cited

FOREIGN PATENT DOCUMENTS

KR 10-2225224 3/2021

OTHER PUBLICATIONS

Kyoda, JP-2014004128-A English translation of description, 2014 (Year: 2014).*
English Specification of 10-1426304.
English Specification of 10-2138308.
English Specification of 20-0414548.
English Specification of 20-0442286.
English Specification of JP2014-004128A.
English Specification of 10-2018-0136136.
English Specification of JP2005-058422A.
English Specification of 10-2225224.

* cited by examiner

EYELASH PERM TREATMENT METHOD AND EYELASH PERM TREATMENT SET APPLIED THERETO

TECHNICAL FIELD

The present invention relates to an eyelash perm treatment method and an eyelash perm treatment set applied thereto, and more particularly, an eyelash perm treatment method and an eyelash perm treatment set applied thereto, which strengthen eyelashes in a more efficient and reliable way than in the prior art, thereby increasing the perm effect for various types of somewhat abnormal hairs to be more preferred by women seeking beauty through eyelashes.

BACKGROUND ART

An eyelash is one of the terminal hairs that grows about 10 mm long at the edge of the eyelids. About 100-150 eyelashes and about 70-80 eyelashes grown at the upper and lower eyelids, respectively.

Eyelashes are very sensitive, and immediately when they come in contact with foreign objects, such as dust, they close the upper and lower eyelids to protect the eyes.

As such, as originally designed to prevent foreign substances, dust, or rainwater from entering the eyes, eyelashes are left as they are. However, a recent trend is to beautify eyes by applying various beauty techniques to the eyelashes.

For example, women who pursue beauty prefer a method for creating a clear and distinct eye shape while making the eyes appear larger by forming curls with the eyelashes rolled up and outward.

To curl up the eyelashes as described above, the eyelash forming devices 1*a* and 1*b* of FIGS. 1 and 2 are commonly used. They have an operation structure in the form of tongs. In other words, the user grips such tongs-shaped structure and presses to curl up the eyelashes.

However, to form curls on the eyelashes in this way, the eyelashes (including the hair roots) should be sturdy. However, in somewhat abnormal cases, such as when the eyelashes are short, the hair is not strong, the eyeballs are protruding, or eyelids are thick, it is not easy to form curls on the eyelashes, so that treatment should be preceded to strengthen the hairs, i.e., perm treatment.

However, since most of the conventional eyelash perm treatment methods selectively use a glue or tape, it is not easy to perform the treatment. Further, due to its limitations in structure or method, the perm solution is not well permeated, so the treatment effect is poor. Thus, a need arises for a brand-new eyelash perm treatment method that has not been known yet.

The prior technical documents in the art to which the invention pertains include Korean Patent/Utility Model Application Nos. 10-2013-0085507, 10-2019-0028700, 20-2006-0003915, and 20-2007-0011566.

DETAILED DESCRIPTION OF THE INVENTION

Technical Problems

The present invention aims to provide an eyelash perm treatment method and an eyelash perm treatment set applied thereto, which strengthen eyelashes in a more efficient and reliable way than in the prior art, thereby increasing the perm effect for various types of somewhat abnormal hairs to be more preferred by women seeking beauty through eyelashes.

Means to Address the Problems

The foregoing objectives are achieved by an eyelash perm treatment method, comprising: an eyelash root strengthening step using a predetermined magnetic rod to strengthen roots of eyelashes using the magnetic rod including a metal plate and a magnetic plate magnetically attached to the metal plate; and an eyelash curl maintaining step using an assemblable synthetic resin rod to continuously maintain curls of the eyelashes to fit eyes, using the assemblable synthetic resin rod after replacing with the assemblable synthetic resin rod including a first synthetic resin unit rod and a second synthetic resin unit rod assemblable or disassemblable from each other.

The eyelash root strengthening step using the magnetic rod may include an eyelash magnetic grip step using the magnetic rod to magnetically grip the eyelashes by placing the metal plate under roots of the eyelashes and placing the magnetic plate over the eyelashes to be magnetically attached to the metal plate; an eyelash first tensioning step of applying predetermined tension to the eyelashes by first curling up the eyelashes by magnetic force of the magnetic rod; a first perm solution application step of applying a predetermined first perm solution to the eyelashes, close to the roots of the eyelashes; a first dry wait step of waiting for a first time while allowing the applied first perm solution to be naturally dried; an eyelash second tensioning step of applying additional tension to the eyelashes by second further curling up the eyelashes by the magnetic force of the magnetic rod to have a force for supporting an eyelid; a first perm solution reapplication step of reapplying the first perm solution to the eyelashes, close to the roots of the eyelashes; a second dry wait step of waiting for a second time, longer than the first step, while allowing the reapplied first perm solution to be naturally dried; a first perm solution washing step of wiping and washing the first perm solution using a predetermined washing tool and water; and a magnetic rod removing step of removing the magnetic rod.

A sum of the first time and the second time does not exceed 10 minutes, and the eyelash root strengthening step using the magnetic rod may be repeated multiple times if necessary.

The eyelash curl maintaining step using the assemblable synthetic resin rod may include a first synthetic resin unit rod placing step of placing the first synthetic resin unit rod under the eyelashes; a first synthetic resin unit rod eyelash attaching step of attaching the eyelashes onto an upper surface of the first synthetic resin unit rod using a predetermined solution and a brush; a second synthetic resin unit rod assembling step of placing the second synthetic resin unit rod under the eyelashes while assembling the second synthetic resin unit rod to the first synthetic resin unit rod; a second synthetic resin unit rod eyelash attaching step of attaching the eyelashes onto an upper surface of the second synthetic resin unit rod using the predetermined solution and a brush; a second perm solution application step of applying a predetermined second perm solution to the eyelashes on the assemblable synthetic resin rod; a dry wait step of allowing the applied second perm solution to be naturally dried; a second perm solution washing step of wiping and washing the second perm solution using a predetermined washing tool and water; and an assemblable synthetic resin rod removing step of removing the assemblable synthetic resin rod.

The eyelash curl maintaining step using the assemblable synthetic resin rod may further include an eyelash managing step of managing the eyelashes with a predetermined cosmetic after the assemblable synthetic resin rod removing step is performed.

On the other hand, the foregoing objectives are also achieved by an eyelash perm treatment set applied to an eyelash perm treatment method, comprising: a magnetic rod strengthening roots of eyelashes; and an assemblable synthetic resin rod continuously maintaining curls of the eyelashes fitting eyes, wherein the magnetic rod includes a metal plate disposed under the eyelashes; and a magnetic plate magnetically attachable to an upper portion of the metal plate, with the eyelashes disposed therebetween, wherein the assemblable synthetic resin rod includes a first synthetic resin unit rod having a first assembling part formed on one side thereof; and a second synthetic resin unit rod having a second assembling part, assemblable or disassemblable with the first assembling part, formed on one side thereof and detachably assemblable with the first synthetic resin unit rod.

Effects of the Invention

According to the present invention, it is possible to strengthen eyelashes in a more efficient and reliable way than in the prior art, thereby increasing the perm effect for various types of somewhat abnormal hairs to be more preferred by women seeking beauty through eyelashes.

MODE TO PRACTICE THE INVENTION

Figure 1:
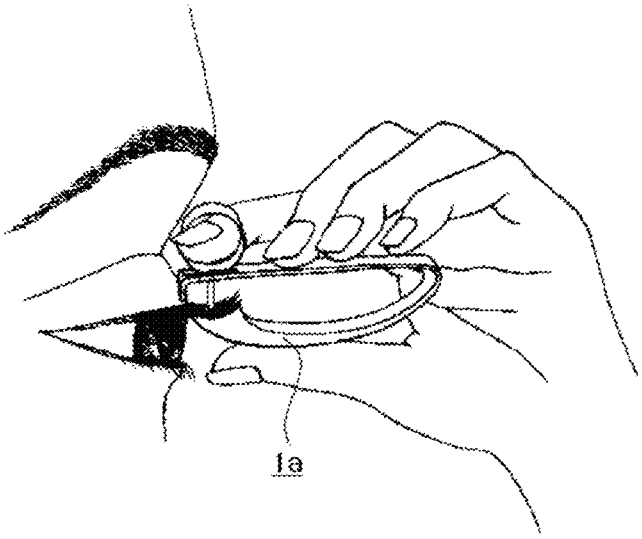
FIG. 1 PRIOR ART
FIGS. 1 and 2 are views illustrating a structure of a conventional eyelash forming tool.
Figure 2:
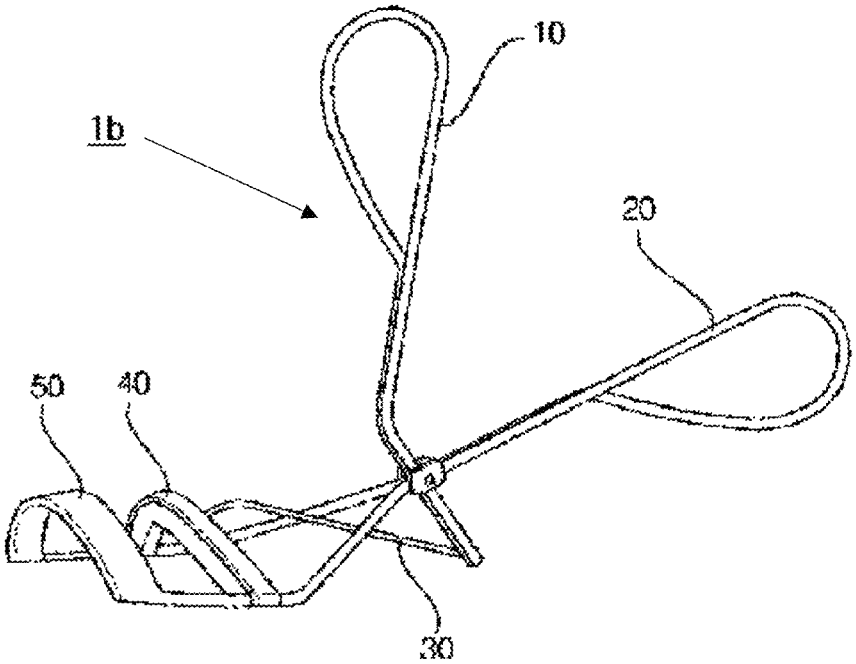
FIG. 2 PRIOR ART

Advantages and features of the present invention, and methods for achieving the same may be apparent from the embodiments described below with reference to the accompanying drawings.

However, the scope of the disclosure is not limited to embodiments described herein, but rather, other various changes may be made thereto.

However, the present disclosure is not limited to the embodiments disclosed herein, and various changes may be made thereto. The embodiments disclosed herein are provided only to inform one of ordinary skilled in the art of the category of the present disclosure. The present disclosure is defined only by the appended claims. The scope of the disclosure is defined by the appended claims.

In some embodiments, known components, operations, and techniques are not described in detail to avoid the disclosure from ambiguity in interpretation.

The same reference numeral denotes the same element throughout the specification. The terms as used herein are provided merely to describe some embodiments thereof, but not intended as limiting the present invention.

As used herein, the singular forms "a," "an," and "the" are intended to include the plural forms as well, unless the context clearly indicates otherwise. As used herein, the term "comprises" and/or "comprising" does not exclude the presence or addition of one or more other components, steps, operations, and/or elements than the component, step, operation, and/or element already mentioned.

Unless defined otherwise, all the terms (including technical and scientific terms) used herein may be construed as commonly appreciated by one of ordinary skill in the art to which the present invention pertains.

Further, terms defined in a dictionary commonly used are not ideally or overly interpreted unless defined expressly or specifically.

Hereinafter, embodiments of the present invention are described in detail with reference to the accompanying drawings.

Figure 3:
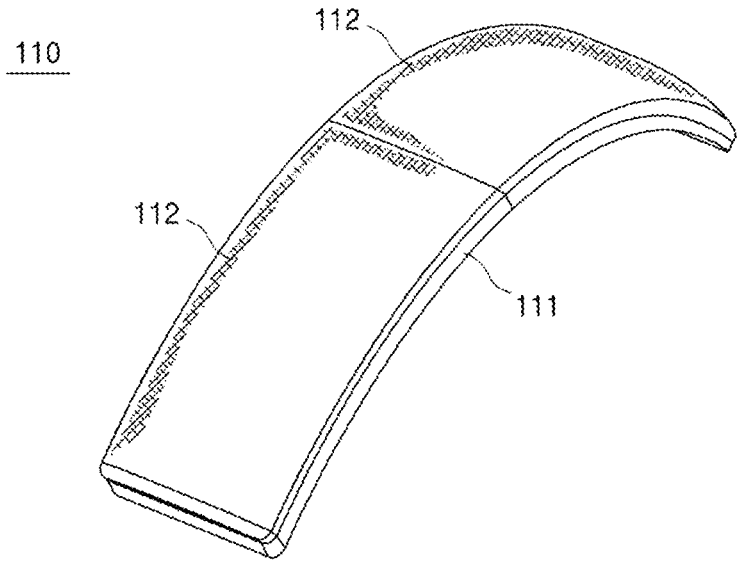
FIG. 3 is a perspective view illustrating a magnetic rod of an eyelash perm treatment set according to an embodiment of the present invention.
Figure 4:
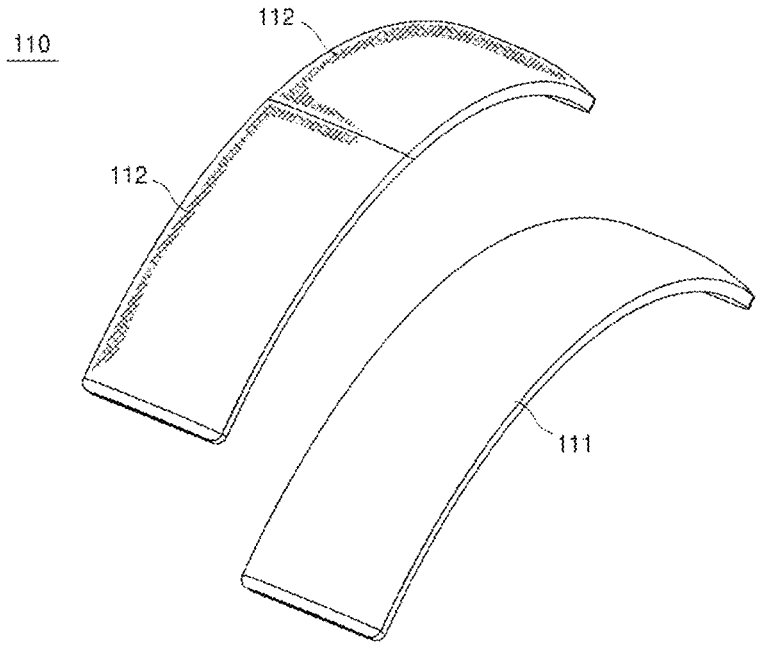
FIG. 4 is an exploded view of FIG. 3.
Figure 5:
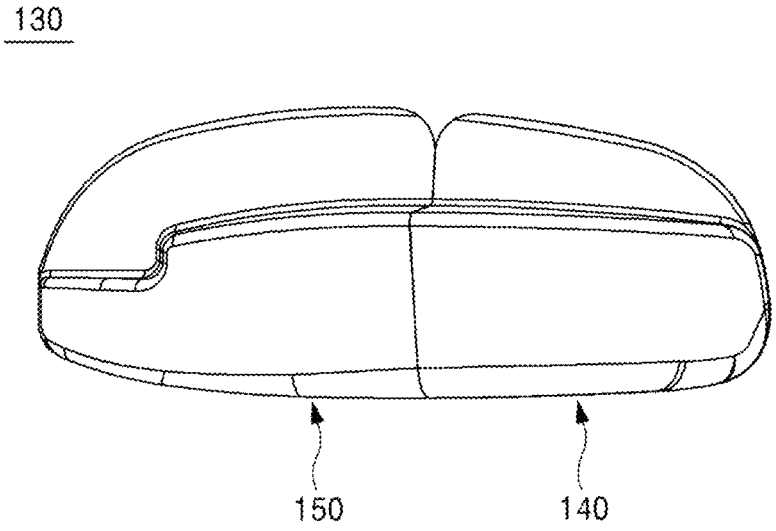
FIG. 5 is a perspective view illustrating an assemblable synthetic resin rod of an eyelash perm treatment set according to an embodiment of the present invention.
Figure 6:
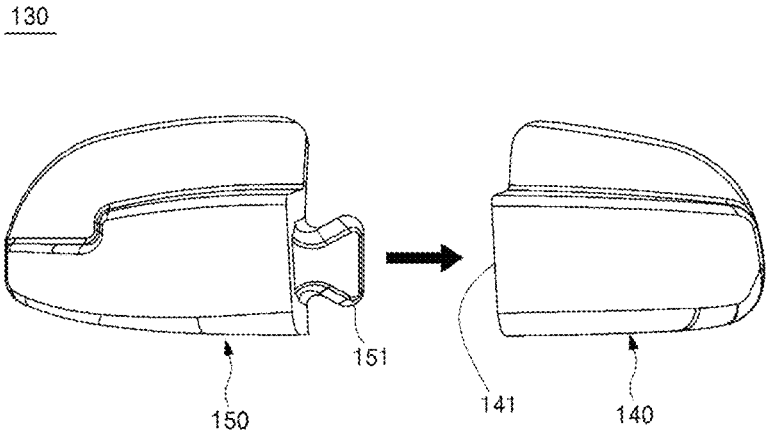
FIG. 6 is an exploded view of FIG. 5.
Figure 7:
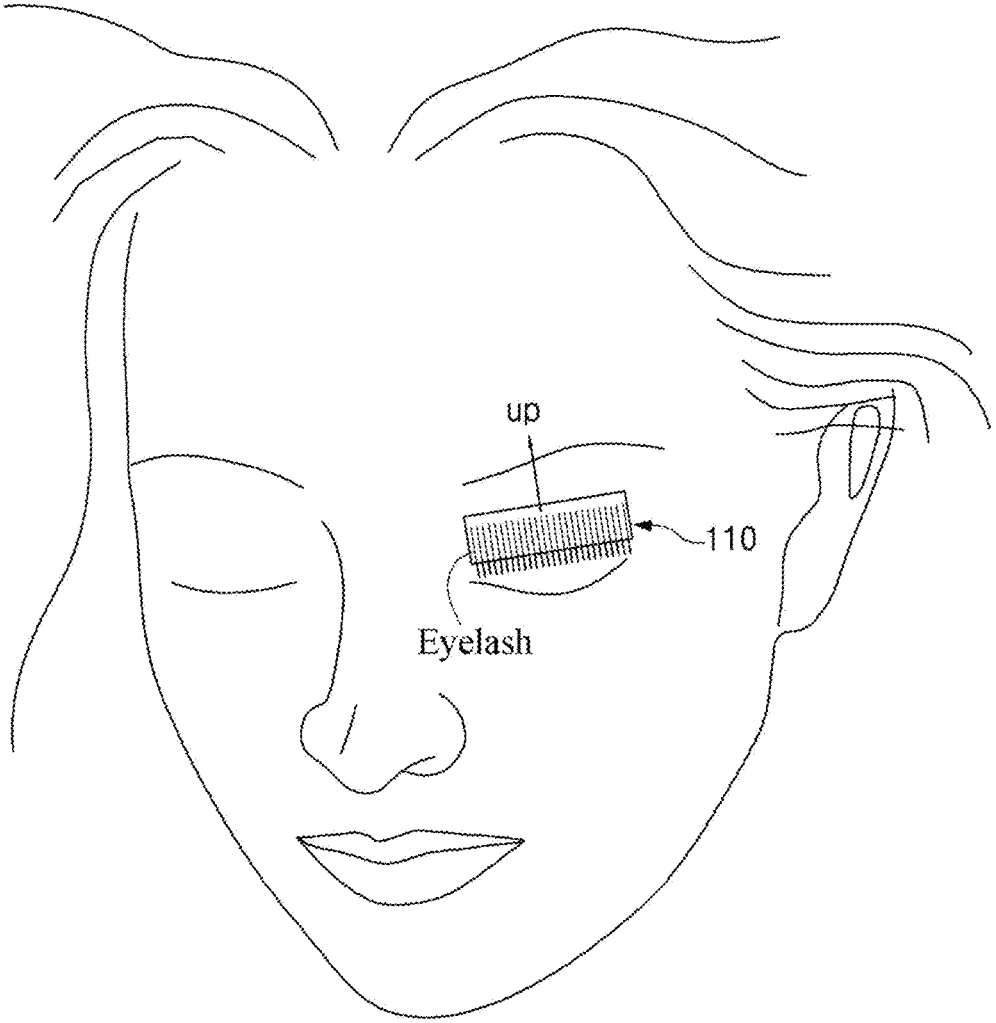
FIG. 7 is a view illustrating an example in which a magnetic rod is applied.
Figure 8:
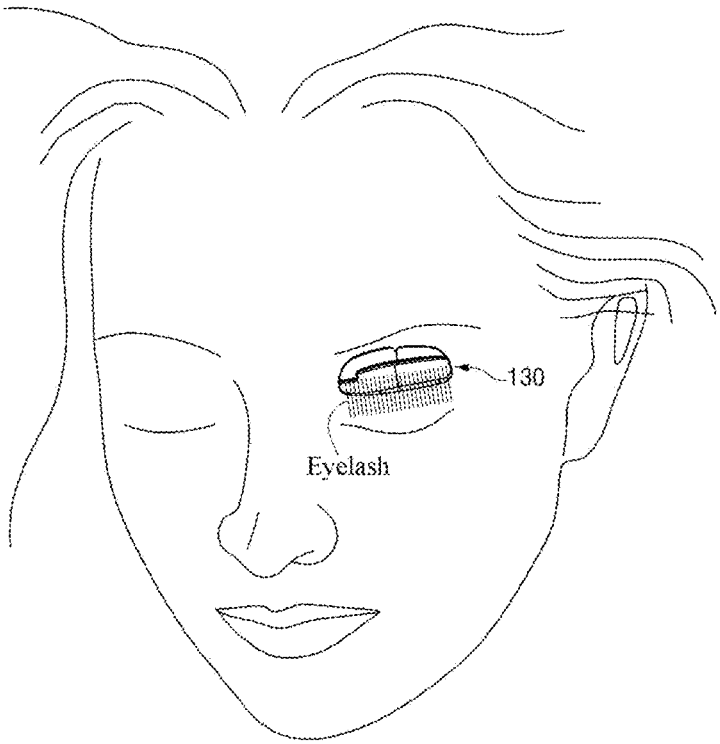
FIG. 8 is a view illustrating an example in which an assemblable synthetic resin rod is applied.
Figure 9:
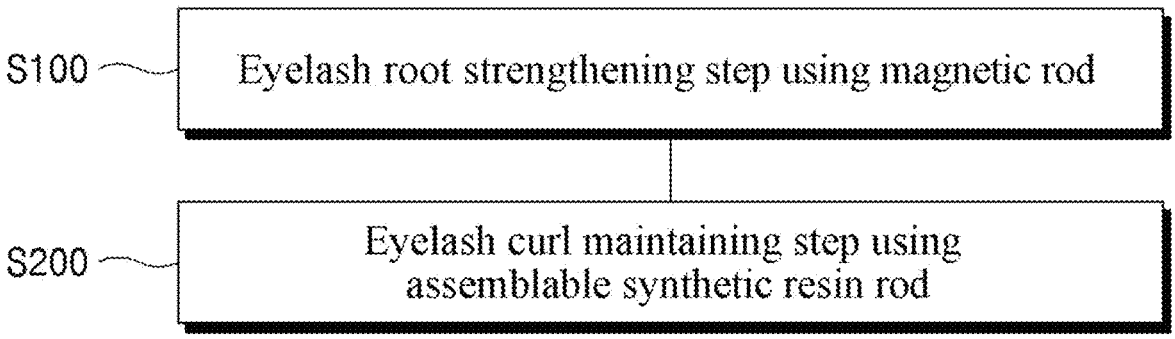
FIG. 9 is a flowchart illustrating an eyelash perm treatment method according to an embodiment of the present invention.
Figure 10:
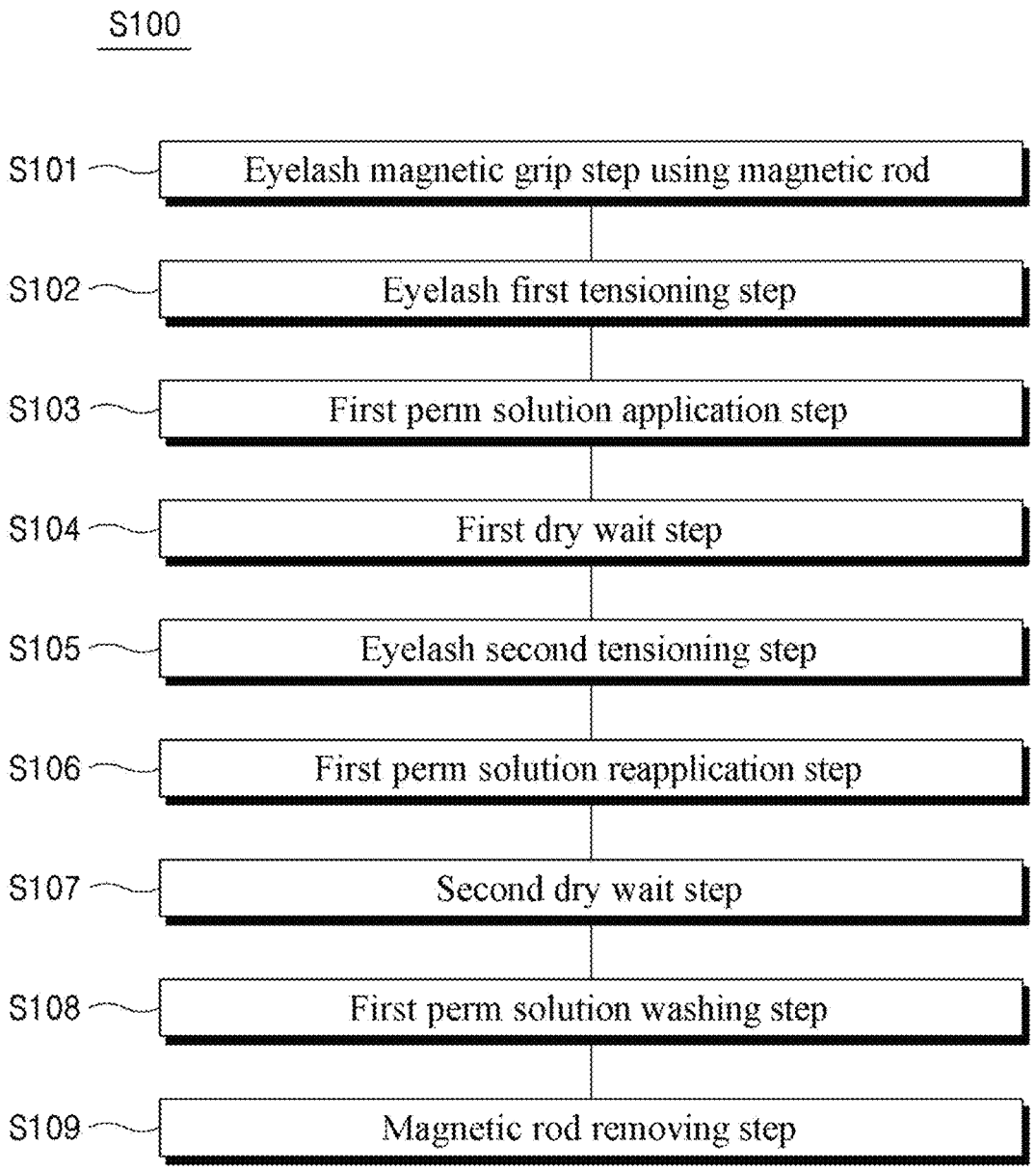
FIG. 10 is a detailed process diagram of an eyelash root strengthening step using the magnetic rod of FIG. 9.
Figure 11:
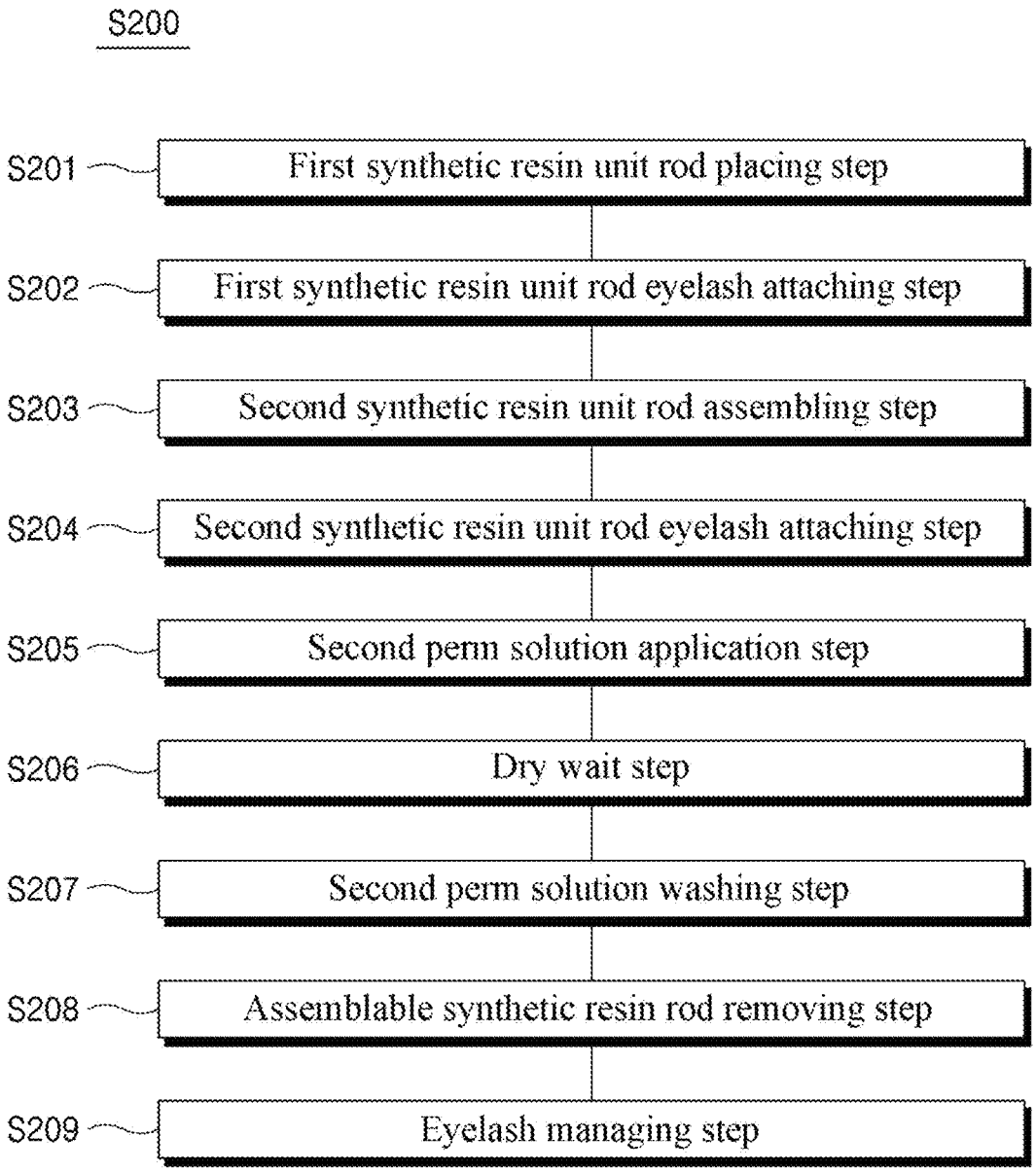
FIG. 11 is a detailed process diagram of an eyelash curl maintaining step using the assemblable synthetic resin rod of FIG. 9.
Figure 12:
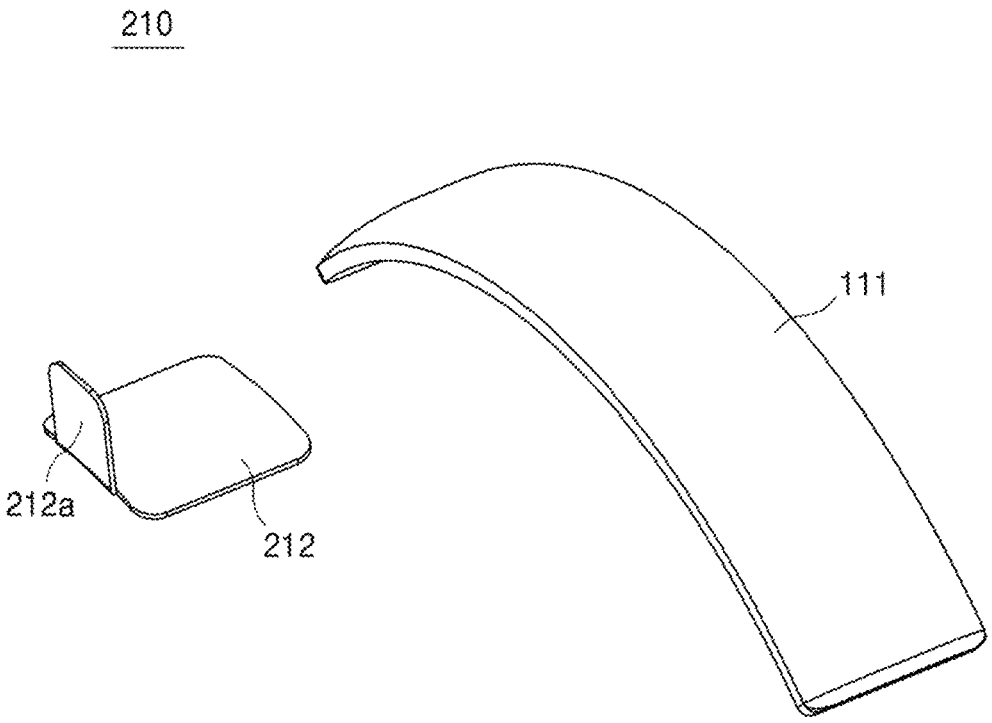
FIG. 12 is a view illustrating a modified embodiment of the magnetic rod.

FIG. 3 is a perspective view illustrating a magnetic rod of an eyelash perm treatment set according to an embodiment of the present invention. FIG. 4 is an exploded view of FIG. 3. FIG. 5 is a perspective view illustrating an assemblable synthetic resin rod of an eyelash perm treatment set according to an embodiment of the present invention. FIG. 6 is an exploded view of FIG. 5. FIG. 7 is a view illustrating an example in which a magnetic rod is applied. FIG. 8 is a view illustrating an example in which an assemblable synthetic resin rod is applied. FIG. 9 is a flowchart illustrating an eyelash perm treatment method according to an embodiment of the present invention. FIG. 10 is a detailed process diagram of an eyelash root strengthening step using the magnetic rod of FIG. 9. FIG. 11 is a detailed process diagram of an eyelash curl maintaining step using the assemblable synthetic resin rod of FIG. 9. FIG. 12 is a view illustrating a modified embodiment of the magnetic rod.

Referring to the drawings, the present invention may strengthen eyelashes (refer to FIGS. 7 and 8) in a more efficient and reliable way than in the prior art, thereby increasing the perm effect for various types of somewhat abnormal hairs to be more preferred by women seeking beauty through eyelashes.

An eyelash perm treatment method according to an embodiment of the present invention, which may provide such effects, may include an eyelash root strengthening step S100 using a magnetic rod and an eyelash curl maintaining step S200 using an assemblable synthetic resin rod as shown in FIG. 9.

To perform the steps, an eyelash perm treatment set according to an embodiment of the present invention is needed and is described first.

As shown in FIGS. 3 to 6, an eyelash perm treatment set according to an embodiment of the present invention may include a magnetic rod 110 and an assemblable synthetic resin rod 130.

The magnetic rod 110 serves to strengthen the roots of the hairs forming the eyelashes. The assemblable synthetic resin rod 130 serves to continuously maintain the curls of the eyelashes that fit the eyes. As shown in FIG. 7, the magnetic rod 110 may be used first, and the assemblable synthetic resin rod 130 may then be used as shown in FIG. 8.

Referring to FIGS. 3 and 4, the magnetic rod 110 may include a metal plate 111 disposed under the hairs and a magnetic plate 112 that may be magnetically attached onto the top of the metal plate 111, with the hairs interposed therebetween.

In this case, the magnetic plate 112 may have a two-section structure, but is not necessarily limited thereto. In other words, the size of the magnetic plate 112 may be identical to the size of the metal plate 111.

Of course, the magnetic plate 112 may have a different shape. In other words, as shown in FIG. 12, illustrating a modified embodiment of the magnetic rod 210, the magnetic plate 212 may be smaller in size than the metal plate 111 and may have a handle 212*a* on a side thereof.

No matter what shape the magnetic rod 110 or 210 is formed, the shape of the magnetic rod is meaningless as long as it may serve to strengthen the roots of the hairs. Hereinafter, the magnetic rod 110 shown in FIGS. 3 and 4 is primarily described.

Referring to FIGS. 5 and 6, the assemblable synthetic resin rod 130 may include a first synthetic resin unit rod 140 having a first assembling part 141 formed on one side thereof and a second synthetic resin unit rod 150 having a second assembling part 151 formed on one side thereof to be assembled or disassembled with the first assembling part 141 and detachably assemblable with the first synthetic resin unit rod 140.

The first assembling part 141 is shaped as a recess, and the second assembling part 151 is shaped as a protrusion, and vice versa. Further, in this embodiment, the second synthetic resin unit rod 150 is formed to be larger in size than the first synthetic resin unit rod 140, but the opposite is also possible. Further, the first synthetic resin unit rod 140 and the second synthetic resin unit rod 150 may have the same size. All of such cases belong to the scope of the present invention.

Meanwhile, as mentioned above, the eyelash perm treatment method according to the embodiment may include the eyelash root strengthening step S100 using the magnetic rod as shown in FIG. 9 and the eyelash curl maintaining step S200 using the assemblable synthetic resin rod as shown in FIGS. 8 and 9.

The eyelash root strengthening step S100 using the magnetic rod is a step for strengthening the roots of the hairs of the eyelashes using the magnetic rod 100 including the metal plate 111 and the magnetic plate 112 magnetically attached to the metal plate 111 as shown in FIG. 7.

The eyelash root strengthening step S100 using the magnetic rod may include an eyelash magnetic grip step S101 using the magnetic rod to magnetically grip the eyelashes by placing the metal plate 111 under roots of the eyelashes and placing the magnetic plate 112 over the eyelashes to be magnetically attached to the metal plate 111, an eyelash first tensioning step S102 of applying predetermined tension to the eyelashes by first curling up the eyelashes by magnetic force of the magnetic rod 110, a first perm solution application step S103 of applying a predetermined first perm solution to the eyelashes, close to the roots of the eyelashes, a first dry wait step S104 of waiting for a first time while allowing the applied first perm solution to be naturally dried, an eyelash second tensioning step S105 of applying additional tension to the eyelashes by second further curling up the eyelashes by the magnetic force of the magnetic rod 110 to have a force for supporting an eyelid, a first perm solution reapplication step S106 of reapplying the first perm solution to the eyelashes, close to the roots of the eyelashes, a second dry wait step S107 of waiting for a second time, longer than the first step, while allowing the reapplied first perm solution to be naturally dried, a first perm solution washing step S108 of wiping and washing the first perm solution using a predetermined washing tool and water, and a magnetic rod removing step S109 of removing the magnetic rod 110.

The steps may be quickly performed so that the sum of the first time and the second time does not exceed 10 minutes. For example, the first time may be three minutes, and the second time may be seven minutes or shorter.

If the abnormality of the eyelashes is significant, the eyelash root strengthening step S100 using the magnetic rod may be repeated multiple times as necessary, which should be interpreted to belong to the scope of the present invention.

Next, the eyelash curl maintaining step S200 using the assemblable synthetic resin rod is a step of continuously maintaining the curls of the eyelashes, fitting eyes, using the assemblable synthetic resin rod 130 after replacing with the assemblable synthetic resin rod 130 including the first and second synthetic resin unit rods 140 and 150, which are assemblable or disassemblable with each other, as shown in FIG. 8.

The eyelash curl maintaining step S200 using the assemblable synthetic resin rod may include a first synthetic resin unit rod placing step S201 of placing the first synthetic resin unit rod 140 under the eyelashes, a first synthetic resin unit rod eyelash attaching step S202 of attaching the eyelashes onto an upper surface of the first synthetic resin unit rod 140 using a predetermined solution and a brush, a second synthetic resin unit rod assembling step S203 of placing the second synthetic resin unit rod 150 under the eyelashes while assembling the second synthetic resin unit rod 150 to the first synthetic resin unit rod 140, a second synthetic resin unit rod eyelash attaching step S204 of attaching the eyelashes onto an upper surface of the second synthetic resin unit rod 150 using the predetermined solution and a brush, a second perm solution application step S205 of applying a predetermined second perm solution to the eyelashes on the assemblable synthetic resin rod 130, a dry wait step S206 of allowing the applied second perm solution to be naturally dried, a second perm solution washing step S207 of wiping and washing the second perm solution using a predetermined washing tool and water, an assemblable synthetic resin rod removing step S208 of removing the assemblable synthetic resin rod 130, and an eyelash managing step S209 of managing the eyelashes with a predetermined cosmetic.

Hereinafter, the eyelash perm treatment method is briefly described sequentially.

First, the metal plate 111 is placed under the eyelashes, and the magnetic plate 112 is placed over the eyelashes to be magnetically attached to the metal plate 111 to thus grip the eyelashes magnetically. A predetermined degree of tension is applied to the eyelashes by first curling up the eyelashes by the magnetic force of the magnetic rod 110.

Then, a predetermined first perm solution is applied to the eyelashes, adjacent to, i.e., very close to, the roots of the eyelashes. The applied first perm solution is left to be naturally dried while waiting for a first time, e.g., three minutes.

Next, the eyelashes are further, secondarily curled up by the magnetic force of the magnetic rod 110 to apply additional tension to the eyelashes so as to have force to support the eyelid. Then, the first perm solution is reapplied to the eyelashes, close to the roots of the eyelashes.

Then, the reapplied first perm solution is left to be naturally dried, waiting for a second time, e.g., seven minutes, longer than the first time. Since the eyelashes get thinner from the roots to the tips, and damage occurs over time while absorbing the perm solution, it is preferable to reduce damage by decreasing the absorption of the eyelashes depending on the thickness over time.

Next, the first perm solution is wiped and washed out using a predetermined washing tool and water. Then, the magnetic rod 110 is removed.

Then, the assemblable synthetic resin rod 130 is positioned where the magnetic rod 110 now removed used to be. Among assemblable synthetic resin rods (not shown) with various shapes and sizes, an assemblable synthetic resin rod 130 that fits the user's eye is selected and is used to curl up the eyelashes.

In this case, the reason for replacing the magnetic rod 110 with the assemblable synthetic resin rod 130 is to continuously implement pretty curls without touching the eyelid.

In somewhat abnormal cases, such as when the eyeballs protrude or when the eyelid is thick, it is not easy to mount the entire rod around the eye at one time. Thus, in this embodiment, the first synthetic resin unit rod 140 is first used, and the second synthetic resin unit rod 150 is then assembled to the first synthetic resin unit rod 140 and used.

First, the first synthetic resin unit rod 140 is placed under the eyelashes. Then, a predetermined solution, e.g., aroma balm or beeswax, is used to attach the eyelashes to the upper surface of the first synthetic resin unit rod 140.

Then, the second synthetic resin unit rod 150 is assembled to the first synthetic resin unit rod 140, and the second synthetic resin unit rod 150 is placed under the eyelashes. Then, a predetermined solution, e.g., aroma balm or beeswax, is used to attach the eyelashes to the upper surface of the second synthetic resin unit rod 150.

Next, a predetermined second perm solution is applied to the eyelashes on the assemblable synthetic resin rod 130. Then, the applied second perm solution is left to be naturally dried. This may take about 10 minutes.

Then, the second perm solution is wiped and washed out using a predetermined washing tool and water, and then, the assemblable synthetic resin rod 130 is removed. Then, the eyelashes are managed with a predetermined cosmetic that is good for eyelash health.

According to the present embodiment that works based on the above-described structure, it is possible to strengthen eyelashes in a more efficient and reliable way than in the prior art, thereby increasing the perm effect for various types of somewhat abnormal hairs to be more preferred by women seeking beauty through eyelashes.

It is appreciated by one of ordinary skilled in the art that the scope of the disclosure is not limited to the embodiments set forth herein, and various changes or modifications may be made thereto without departing from the scope and spirit of the disclosure. Thus, such changes or modifications also belong to the scope of the disclosure defined by the appended claims.

*LEGEND OF REFERENCE NUMBERS*

110: magnetic rod 111: metal plate
112: magnet plate 130: assemblable synthetic resin rod
140: first synthetic resin unit rod 141: first assembling part
150: second synthetic resin unit rod 151: second assembling part

The invention claimed is:

1. An eyelash perm treatment method, comprising:

strengthening an eyelash root using a predetermined magnetic rod to strengthen roots of eyelashes using the magnetic rod including a metal plate and a magnetic plate magnetically attached to the metal plate; and maintaining an eyelash curl using an assemblable synthetic resin rod to continuously maintain curls of the eyelashes to fit eyes, using the assemblable synthetic resin rod after replacing with the assemblable synthetic resin rod including a first synthetic resin unit rod and a second synthetic resin unit rod assemblable or disassemblable from each other, wherein strengthening the eyelash root using the magnetic rod includes:

magnetically grip the eyelashes, using the magnetic rod, by placing the metal plate under roots of the eyelashes and placing the magnetic plate over the eyelashes to be magnetically attached to the metal plate;

applying predetermined tension to the eyelashes by first curling up the eyelashes by magnetic force of the magnetic rod;

applying a predetermined first perm solution to the eyelashes, close to the roots of the eyelashes;

waiting for a first time while allowing the applied first perm solution to be naturally dried;

applying additional tension to the eyelashes by second further curling up the eyelashes by the magnetic force of the magnetic rod to have a force for supporting an eyelid;

reapplying the first perm solution to the eyelashes, close to the roots of the eyelashes;

waiting for a second time, longer than the first step, while allowing the reapplied first perm solution to be naturally dried;

wiping and washing the first perm solution using a predetermined washing tool and water; and removing the magnetic rod.

2. The eyelash perm treatment method of claim 1, wherein a sum of the first time and the second time does not exceed 10 minutes, and wherein strengthening the eyelash root using the magnetic rod is repeated multiple times if necessary.

3. The eyelash perm treatment method of claim 1, wherein maintaining the eyelash curl using the assemblable synthetic resin rod includes:

placing the first synthetic resin unit rod under the eyelashes;

attaching the eyelashes onto an upper surface of the first synthetic resin unit rod using a predetermined solution and a brush;

placing the second synthetic resin unit rod under the eyelashes while assembling the second synthetic resin unit rod to the first synthetic resin unit rod;

attaching the eyelashes onto an upper surface of the second synthetic resin unit rod using the predetermined solution and a brush;

applying a predetermined second perm solution to the eyelashes on the assemblable synthetic resin rod;

allowing the applied second perm solution to be naturally dried;

wiping and washing the second perm solution using a predetermined washing tool and water; and removing the assemblable synthetic resin rod.

4. The eyelash perm treatment method of claim 3, wherein maintaining the eyelash curl using the assemblable synthetic resin rod further includes managing the eyelashes with a predetermined cosmetic after the assemblable synthetic resin rod removing step is performed.

* * * * *